US011766620B2

(12) United States Patent
Seale

(10) Patent No.: US 11,766,620 B2
(45) Date of Patent: Sep. 26, 2023

(54) TOY VEHICLE ASSEMBLY

(71) Applicant: Icon23 Pty Ltd, Brisbane (AU)

(72) Inventor: Dallyn Seale, Brisbane (AU)

(73) Assignee: Icon23 Pty Ltd, Queensland (AU)

( * ) Notice: Subject to any disclaimer, the term of this patent is extended or adjusted under 35 U.S.C. 154(b) by 0 days.

(21) Appl. No.: 17/927,864

(22) PCT Filed: May 24, 2021

(86) PCT No.: PCT/AU2021/050488
§ 371 (c)(1),
(2) Date: Nov. 25, 2022

(87) PCT Pub. No.: WO2021/237276
PCT Pub. Date: Dec. 2, 2021

(65) Prior Publication Data

US 2023/0191271 A1 Jun. 22, 2023

(30) Foreign Application Priority Data

May 25, 2020 (AU) ..... 2020100835

(51) Int. Cl.
*A63H 17/26* (2006.01)
*A63H 19/18* (2006.01)

(52) U.S. Cl.
CPC ..... *A63H 17/264* (2013.01)

(58) Field of Classification Search
CPC ..... A63H 17/264; A63H 19/18
USPC ..... 446/95, 431, 465, 470, 491; 213/75 R
See application file for complete search history.

(56) References Cited

U.S. PATENT DOCUMENTS 2,159,974 A * 5/1939 Lohr ..... A63H 29/04 446/431
2,701,152 A * 2/1955 Cutler ..... A63H 19/18 280/514
2,782,559 A * 2/1957 Strauss ..... A63H 17/264 446/451
3,330,066 A * 7/1967 Crawford ..... A63H 19/18 213/75 D
4,508,517 A * 4/1985 Kulesza ..... A63H 17/264 446/451

(Continued)

FOREIGN PATENT DOCUMENTS

CA 2908596 A1 6/2016
GB 2134398 A 8/1984
GB 2269326 A 2/1994

OTHER PUBLICATIONS

Australian Patent Office, "International Preliminary Report on Patentability Regarding International Application No. PCT/AU2021/050488", dated Apr. 28, 2022, p. 25, Published in: AU.

(Continued)

*Primary Examiner* — Alexander R Niconovich
(74) *Attorney, Agent, or Firm* — Neugeboren O'Dowd PC

(57) ABSTRACT

The present invention relates to a toy vehicle assembly. The assembly includes a first toy vehicle and a second toy vehicle. Furthermore, the assembly includes a connector for connecting the toy vehicles. Advantageously, the toy vehicles may be connected together so that a player may play with both vehicles at the same time with one hand only to thereby significantly enhance the playing experience.

20 Claims, 2 Drawing Sheets

(56) References Cited

U.S. PATENT DOCUMENTS 4,568,300 A * 2/1986 Rasmussen ..... A63H 17/264 446/457
4,940,442 A * 7/1990 Matsuda ..... A63H 17/264 446/457
5,048,704 A * 9/1991 Takahashi ..... H01F 7/0263 213/75 D
5,746,336 A * 5/1998 Edwards ..... A63H 19/18 213/75 TC
5,775,525 A * 7/1998 Brill ..... A63H 19/18 213/75 D
7,137,862 B2 * 11/2006 Arnold ..... A63H 17/00 446/457
7,464,824 B2 * 12/2008 Utsumi ..... A63H 19/18 213/75 TC
8,464,881 B2 * 6/2013 Rieskamp ..... H01F 7/0242 213/75 TC
8,469,210 B2 * 6/2013 MacBain ..... A63H 19/18 446/444
8,708,770 B2 * 4/2014 Hudimac, Jr. ..... A63H 18/14 446/457
8,961,262 B2 * 2/2015 Hudimac, Jr. ..... A63H 17/008 446/457
10,617,965 B2 * 4/2020 Sorensen ..... A63H 33/086
2012/0326818 A1 12/2012 Rieskamp
2016/0158660 A1 * 6/2016 Todokoro ..... A63H 17/36 446/454

OTHER PUBLICATIONS

Australian Patent Office, "International Search Report and Written Opinion Regarding International Application No. PCT/AU2021/050488", dated Sep. 13, 2021, p. 3, Published in: AU.

* cited by examiner

TOY VEHICLE ASSEMBLY

CLAIM OF PRIORITY UNDER 35 U.S.C. § 119

This patent application is a National Stage of International Application No. PCT/AU2021/050488 filed on May 24, 2021, which claims priority to Australian Patent No. 2020100835, entitled "A TOY VEHICLE ASSEMBLY", filed on May 25, 2020, the entire disclosures of which are hereby incorporated by reference for all proper purposes.

TECHNICAL FIELD

The present invention generally relates to a toy vehicle assembly. The present invention has particular, although not exclusive application to toy cars.

BACKGROUND

The reference to any prior art in this specification is not, and should not be taken as an acknowledgement or any form of suggestion that the prior art forms part of the common general knowledge.

A player (typically a child) can control a toy car (e.g. Matchbox™ car) by holding the toy car between fingers of a hand. Often, the player seeks to mimic toy cars racing around a toy race track. In this manner, a second car is held in the other hand and the player controls both cars at once with each car controlled by a respective hand.

The player may have at times, limited space to position two hands holding respective cars, owing to the constrained layout of the desired playing area (i.e. toy road or toy race track). The player may also have limited visibility of the adjacent toy cars when playing with both cars in this manner. Also, if more than one player is playing with the toy cars at the same time, the issues of space and visibility can be exacerbated in the playing area, leading to a lessening of the enjoyment of the playing experience.

The preferred embodiment enhances the playing experience when playing with two toy cars.

SUMMARY

According to one aspect of the present invention, there is provided a toy vehicle assembly including: a first toy vehicle; a second toy vehicle for locating next to the first toy vehicle; and a connector for extending between the sides of the vehicles to connect the toy vehicles, the connector including a linkage including a pair of links, the links being pivotally mounted at either end.

Advantageously, the toy vehicles may be connected together so that a player may play with both vehicles at the same time with one hand only to thereby significantly enhance the playing experience. The player may control both vehicles by only having to control one held toy vehicle. Optionally, the player can turn the first toy vehicle by rotating it and/or by applying a lateral force to its front or its rear using one hand only, which causes the second toy vehicle to move forward or behind or turn in proximity to the first toy vehicle.

The connector may include a linkage. The linkage may include a pair of rigid links. The links may be parallel. The links may be horizontal. The links may be snap-fitting. One of the links may be elevated compared with the other link to that the links can be superposed.

The connector may include a pair of mounting brackets. Each mounting bracket may include a mounting plate for mounting to a vehicle. Each mounting bracket may include a pair of mounting tabs for mounting to a link. The mounting tabs may be at different elevations. Each mounting bracket and/or link may be integrally formed from plastic material (e.g. injection molded).

The connector may include releasable fastening means for releasably fastening to each vehicle. The fastening means may include adhesive (e.g. tape) for adhering to the vehicles, friction grip for friction gripping the vehicles, fasteners (e.g. screws) for fastening to the vehicles, or another form of suitable fixing.

The fastening means may fasten to the underside of each vehicle. Alternatively, the fastening means may fasten to the side of each vehicle.

According to another aspect of the present invention, there is provided a connector for connecting a first toy vehicle and a second toy vehicle, the connector including a linkage, the linkage including a pair of links, the links being pivotally mounted at either end.

According to another aspect of the present invention, there is provided a method for playing with a first toy vehicle and a second toy vehicle, the method involving: connecting the toy vehicles with a connector extending between the sides of the vehicles, the connector including a linkage including a pair of links, the links being pivotally mounted at either end.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
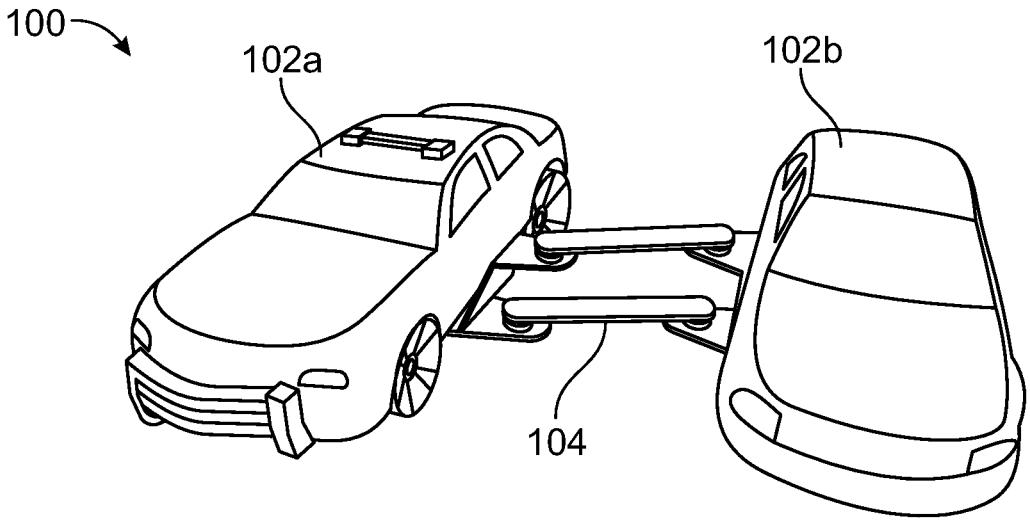
FIG. 1 shows a toy vehicle assembly in accordance with an embodiment of the present invention in an expanded configuration.
Figure 2:
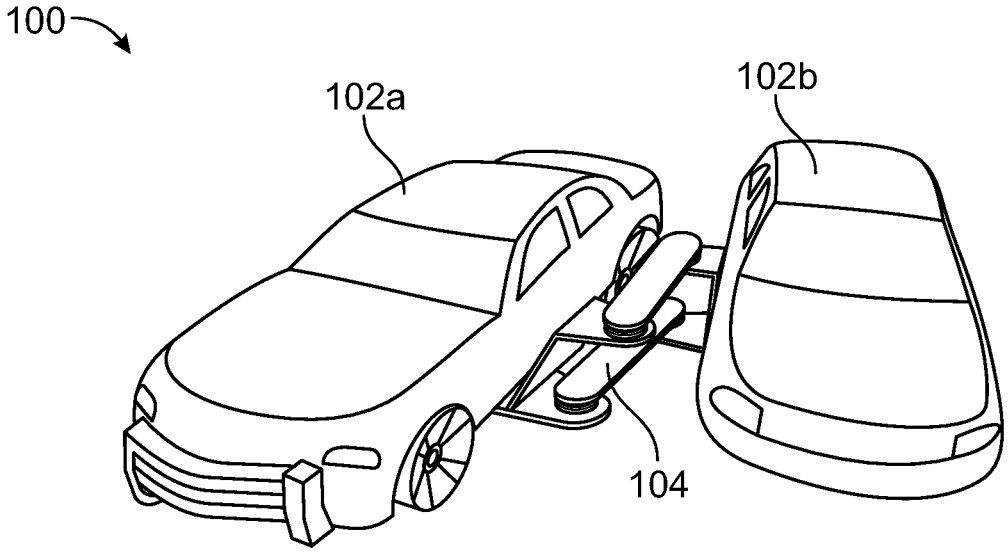
FIG. 2 shows the toy vehicle assembly of FIG. 1 in a retracted configuration.

According to an embodiment of the present invention, there is provided a toy vehicle assembly 100 as shown in FIGS. 1 and 2. The assembly 100 includes a first toy vehicle 102*a* (e.g. car) and a second toy vehicle 102*b*. A connector 104 is retro-fitted to connect the toy vehicles 102 together and extends between the sides of the vehicles 102. The assembly 100 can be maneuvered from an expanded configuration shown in FIG. 1, right through to a retracted configuration shown in FIG. 2.

Advantageously, the toy vehicles 102 can be connected together so that a player can play with both vehicles at the same time with one hand only to thereby significantly enhance the playing experience. The player may control the direction and position of both vehicles 102 by only having to control the direction and position of one held toy vehicle 102*a*. The player can turn the held first toy vehicle 102*a* by rotating it and/or by applying a lateral force to its front or its rear using one hand only (see FIG. 1), which causes the second un-held toy vehicle 102*b* to move forward or behind or turn in proximity to the first toy vehicle 102*a* (see FIG. 2).

Figure 3:
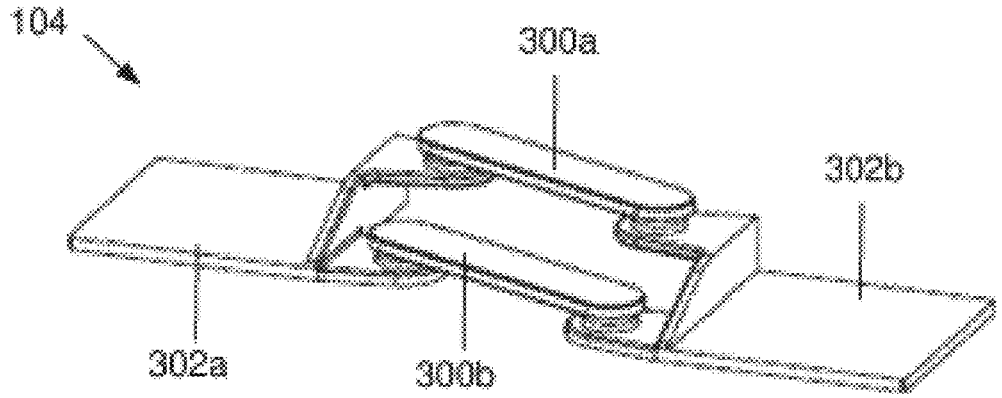
FIG. 3 is a perspective view of a connector of the toy vehicle assembly of FIG. 1.

Turning to FIG. 3, the connector 104 is in the form of a mechanical linkage having a pair of rigid links 300*a*, 300*b*. The links 300 are parallel, horizontal, and pivotally mounted at either end to respective mounting brackets 302*a*, 302*b*. One of the links 300*a* is elevated compared with the other link 300*b* so that the links 300 can be superposed without interference in the retracted configuration (FIG. 2). Each link 300 and mounting bracket 302 is integrally formed from plastic material by injection molding.

Figure 4:
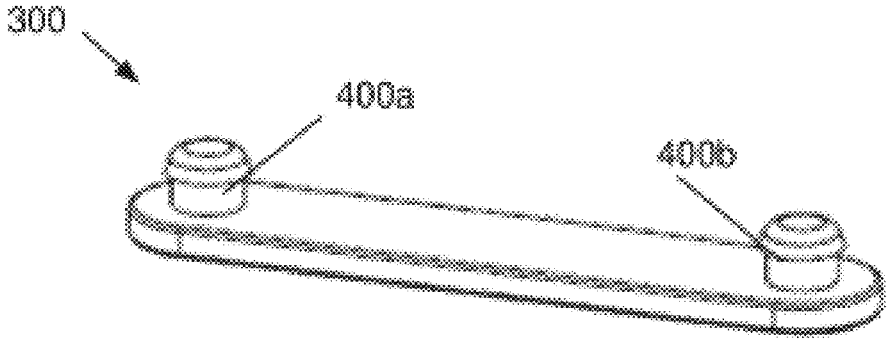
FIG. 4 is a perspective view of a link of the connector of FIG. 3.

Turning to FIG. 4, each link 300 has a pair of posts 400*a*, 400*b* with enlarged heads for snap-fitting to the mounting brackets 302*a*, 302*b*.

Figure 5:
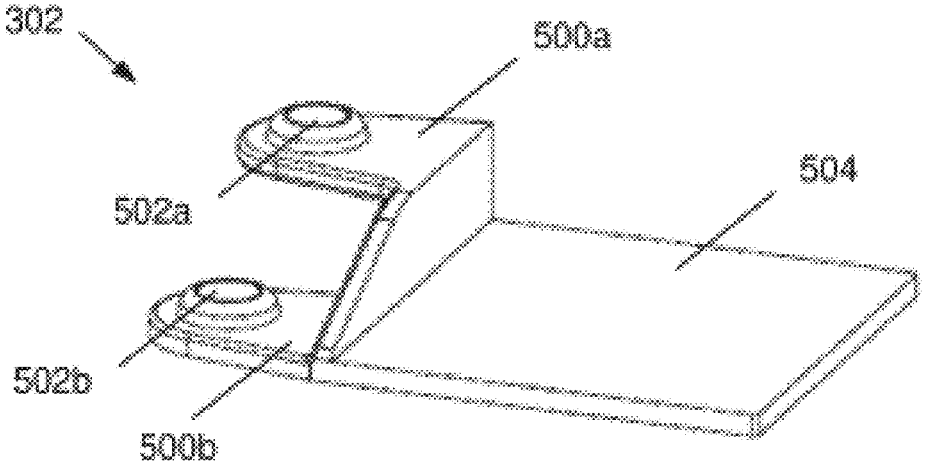
FIG. 5 is a perspective view of a mounting bracket of the connector of FIG. 3.

Turning to FIG. 5, each mounting bracket 302 includes a pair of mounting tabs 500*a*, 500*b* for mounting to the links 300*a*, 300*b*. The mounting tabs 500 are at different elevations. The tabs 500*a*, 500*b* define apertures 502*a*, 502*b* through which the posts 400 of the links 300 are snap-fitted. Each mounting bracket 302 includes a mounting plate 504 for mounting to the underside of a vehicle 102.

The connector 104 includes releasable fastening means in the form of double-sided tape for releasably fastening to each vehicle 102. The double-sided tape includes adhesive on one side for adhering to the underside of the vehicles 102 and adhesive on the other side for adhering to the mounting plate 504. The two-sided adhesive tape may be preferred by players as it can be interchangeably linked between different vehicles 102 several times before the adhesive contact of the two-sided tape reduces its effectiveness. Thence it can be replaced and the linkage can be used multiple times between multiple toy vehicles 102.

The connector 104 may be provided as a retro-fit item for connecting to vehicles 102, or the assembly 100 may be provided as a kit. Either way, the player can connect the toy vehicles 102*a*, 102*b* with the connector 104.

The geometry of the connector 104 allows the player to effectively "race" the two vehicles 102*a*, 102*b* around a desired path (e.g. toy race track) by positioning one vehicle 102*a* and rotating it relative to its path of motion with one hand only, and whereby both vehicles 102*a*, 102*b* are positioned "racing" in close proximity to one another.

Importantly, the action of the connector linkage allows the motion of the unheld second toy vehicle 102*b* to be completely controlled though the motion inputs given to the linked first toy vehicle 102*a* held by the player.

An important experiential aspect of the connector linkage is the appearance of the vehicles 102 to be "drifting" adjacent to one another when being moved through a corner maneuver, thereby significantly enhancing the playing experience of the player.

Also, the use of two of more connector linkages connecting multiple pairs of toy vehicles 102 allows one player to play with multiple vehicles 102 at a time, or for multiple players to play with more vehicles 102 at a time, than would otherwise be the case, and without the available space and visibility limitations than would otherwise be the case.

The resultant outcome of the implementation and use of the connector linkage is a much-heightened level of enjoyment of play with toy vehicles 102 in all manner of experiences, thereby improving and enhancing the role of play with an existing globally used toy vehicle 102 that has enormous market appeal and which has existed in the global toy market for decades.

A person skilled in the art will appreciate that many embodiments and variations can be made without departing from the ambit of the present invention.

The fastening means may include a friction grip for friction gripping the vehicles 102, fasteners (e.g. screws) for fastening to the vehicles 102, or another form of suitable fixing.

The fastening means may fasten to the side of each vehicle 102. In particular, the connector linkage could also be fixed to the adjacent vehicles 102 not by a flat plate 302 under the base of the toy vehicles 102 as envisaged by the preferred embodiment, but it could also be affixed by attaching the two outer rotating pivot points of the linkage to a side fixing plate affixed to the side of the toy vehicles 102 (by either adhesive tape, friction grips, screws etc).

Each link 300 and mounting bracket 302 need not be formed from plastic material, and instead may made from metal by die-casting or some other form of metal manufacturing.

In one embodiment, the connector 104 includes three or more links 300.

The preferred embodiment has described in relation to first and second vehicles 102*a*, 102*b*. In other embodiments, a third vehicle 102*c* may be connected on the other side of the second vehicle 102*b* with a connector 104. In this manner, a serial chain of any number of vehicles 102 interconnected with connectors 104 may be formed.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The claims defining the invention are as follows:

1. A toy vehicle assembly including:

a first toy vehicle;

a second toy vehicle for locating next to the first toy vehicle; and a connector for connecting the first toy vehicle and the second toy vehicle and extending between a first side of the first toy vehicle and a second side of the second toy vehicle, the connector including a linkage including a pair of links, the pair of links being pivotally mounted at either end.

2. The toy vehicle assembly as claimed in claim 1, wherein the first toy vehicle and the second toy vehicle are configured such that a player can play with both vehicles at the same time with one hand only to thereby significantly enhance the player's playing experience.

3. The toy vehicle assembly as claimed in claim 1, wherein a player manipulates both the first toy vehicle and the second toy vehicle by manipulating either one of the first toy vehicle and the second toy vehicle.

4. The toy vehicle assembly as claimed in claim 1, wherein the first toy vehicle is further configured to rotate by application of a lateral force by, a player to one of a front or a rear of the first toy vehicle.

5. The toy vehicle assembly as claimed in claim 4, wherein the second toy vehicle is configured to move in tandem with the first toy vehicle.

6. The toy vehicle assembly as claimed in claim 1, wherein the pair of links are elongate and located adjacent each other.

7. The toy vehicle assembly as claimed in claim 1, wherein the pair of links are rigid.

8. The toy vehicle assembly as claimed in claim 1, wherein the pair of links are parallel.

9. The toy vehicle assembly as claimed in claim 1, wherein the pair of links are configured to move relative to each other during use, and wherein the first toy vehicle and the second toy vehicle remain substantially parallel to each other when turning.

10. The toy vehicle assembly as claimed in claim 1, wherein the pair of links are horizontal.

11. The toy vehicle assembly as claimed in claim 1, wherein the pair of links are snap-fitting.

12. The toy vehicle assembly as claimed in claim 1, wherein one of the pair of links is elevated compared with the other link such that the pair of links are superposed.

13. The toy vehicle assembly as claimed in claim 1, wherein the connector further comprises a pair of mounting brackets.

14. The toy vehicle assembly as claimed in claim 13, wherein each mounting bracket of the pair of mounting brackets includes a mounting plate for mounting to the first toy vehicle and the second toy vehicle.

15. The toy vehicle assembly as claimed in claim 13, wherein each mounting bracket of the pair of mounting brackets includes a pair of mounting tabs for mounting to at least one link of the pair of links, the mounting tabs being at different elevations, and wherein each mounting bracket and/or link is integrally formed from a plastic material.

16. The toy vehicle assembly as claimed in claim 1, wherein the connector further comprises releasable fastening means for releasably fastening to each of the first toy vehicle and the second toy vehicle.

17. The toy vehicle assembly as claimed in claim 16, wherein the releasable fastening means includes one or more of:

adhesive configured to adhere to the first toy vehicle and the second toy vehicle, friction grip configured to grip the first toy vehicle and the second toy vehicle, and fasteners configured to fasten the releasable fastening means to the first toy vehicle and the second to vehicle.

18. The toy vehicle assembly as claimed in claim 16, wherein the releasable fastening means is configured to fasten to an underside of each of the first toy vehicle and the second toy vehicle or to the first side of the first toy vehicle or the second side of the second toy vehicle.

19. A toy vehicle assembly comprising:

a connector configured to join a first toy vehicle with a second toy vehicle, wherein:

the connector includes a linkage, the linkage includes a pair of links, and the pair of links are pivotally mounted at either end to the connector.

20. A method for using a toy vehicle assembly, the method comprising:

connecting, via a connector, a first toy vehicle and a second toy vehicle; wherein:

the connector is configured to extend between a first side of the first tov vehicle and a second side of the second toy vehicle, the connector including a linkage, the linkage including a pair of links, and the pair of links being pivotally mounted at either end to the connector.

* * * * *